US007484644B2

(12) United States Patent
Forsberg

(10) Patent No.: US 7,484,644 B2
(45) Date of Patent: Feb. 3, 2009

(54) DECORATIVE HANGER AND METHOD OF MAKING SAME

(76) Inventor: Mary Elizabeth Forsberg, 36 Story Point, Galena, IL (US) 61036

( * ) Notice: Subject to any disclaimer, the term of this patent is extended or adjusted under 35 U.S.C. 154(b) by 0 days.

(21) Appl. No.: 11/789,486

(22) Filed: Apr. 26, 2007

(65) Prior Publication Data

US 2008/0264985 A1 Oct. 30, 2008

(51) Int. Cl.
*A41D 27/22* (2006.01)

(52) U.S. Cl. ..... 223/98

(58) Field of Classification Search ..... 223/85, 223/86, 87, 88, 92, 95, 98; D6/328
See application file for complete search history.

(56) References Cited

U.S. PATENT DOCUMENTS

| | | | | | |
|---|---|---|---|---|---|
| 2,099,308 | A | * | 11/1937 | McAllister | 223/98 |
| 2,265,789 | A | * | 12/1941 | Vivaudou et al. | 223/86 |
| 2,652,957 | A | * | 9/1953 | Wolf | 223/92 |
| 3,261,518 | A | * | 7/1966 | Everett | 223/91 |
| 3,347,428 | A | * | 10/1967 | Gauthier | 223/98 |
| 4,058,241 | A | * | 11/1977 | Craig | 223/98 |
| 4,606,482 | A | * | 8/1986 | McHugh | 223/88 |
| 5,295,587 | A | * | 3/1994 | Downes et al. | 211/85.2 |
| 6,021,934 | A | * | 2/2000 | Ho | 223/98 |
| 6,053,379 | A | * | 4/2000 | Balph | 223/98 |
| 6,076,685 | A | * | 6/2000 | Ramirez | 211/13.1 |

OTHER PUBLICATIONS

Get Creative Conference Center, Elegant Padded Hanger, Feb. 4, 2005, www.getcreativeshow.com/seminars/padded_hanger.htm.*

* cited by examiner

*Primary Examiner*—Gary L Welch
*Assistant Examiner*—Nathan E Durham
(74) *Attorney, Agent, or Firm*—Charles F. Lind

(57) ABSTRACT

A narrow wrap of colorful cloth is helically wound end-to-end over a hanger body, including its upstanding central and downwardly sloping shoulder regions, but not covering the hanger swivel hook at the central region. A decorative yarn holds the wrap in place, being first secured near one end to the hanger swivel hook, and then being helically wound over one end shoulder region and out to proximate one hanger end and then being wound back over the shoulder and central regions substantially out to the other hanger end and back then to the central region. The yarn is then tied to the swivel hook. A thin padding preferably covers the hanger to underlie the wrap, but the swivel hook extends through a slit therein to be exposed. The ends of the tubular wrap are folded over and secured by the yarn to hide the hanger ends.

1 Claim, 1 Drawing Sheet

DECORATIVE HANGER AND METHOD OF MAKING SAME

BACKGROUND OF THE INVENTION

FIG. 1 shows in a front elevation view a conventional molded plastic garment hanger 10 suited for making the subject invention. The hanger has a thin profile body 12 formed with an upstanding central region 14 and downwardly sloping end or shoulder regions 16, 17. An upstanding swivel hook 18 is secured to the central body region 14, having a downwardly open contour 20 suited for overlying a conventional closet rod or the like for holding the hanger.

The upper and lower edges of the hanger end shoulder regions can have cut-outs 22 and 24 respectively, suited to hook garment straps or the like onto and prevent them from falling off of the otherwise smooth and quite slippery hanger surfaces.

While such hangers can function well to hold garments, they typically are molded of a single color plastic, and thus need not be overly attractive.

OBJECTS OF THE INVENTION

A basic object of this invention is to provide a decorated hanger, and materials and method for decorating a basic plastic top hanger, to provide a decoratively appealing hanger with a frictional cover and/or soft padding for holding garments.

A detailed object of this invention is to provide materials and method for decorating and/or over wrapping a basic plastic hanger, including a resilient padding for overlying the hanger, a ribbon like wrap for helically winding over the padding, and decorative yarn for winding over the wrap, operably holding the components together to define a very serviceable, colorful and attractive hanger.

DESCRIPTION OF THE DRAWINGS

These and other objects of this invention will be more fully understood and appreciated after reviewing the detailed disclosure that follows, including the accompanying drawings, wherein.

DETAILED DESCRIPTION OF THE INVENTION

Figure 1:
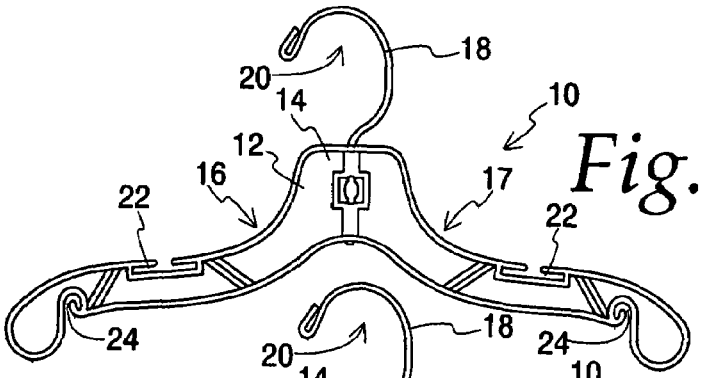
FIG. 1 is an elevation view of a typical top hanger forming the basis of this invention.
Figure 2:
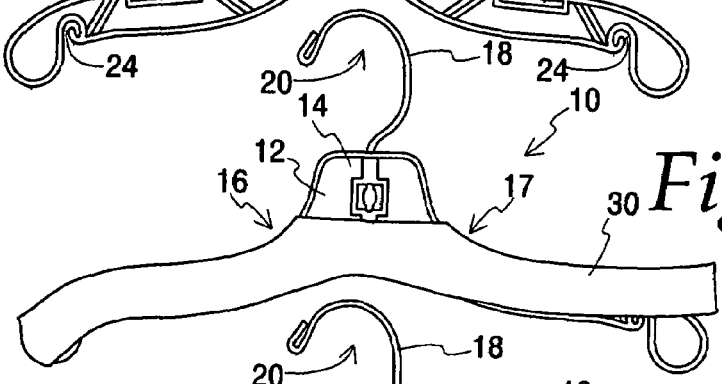
FIG. 2 shows the hanger of FIG. 1, where padding is secured on the left end of the hanger and only partly secured on the right end thereof.
Figure 3:
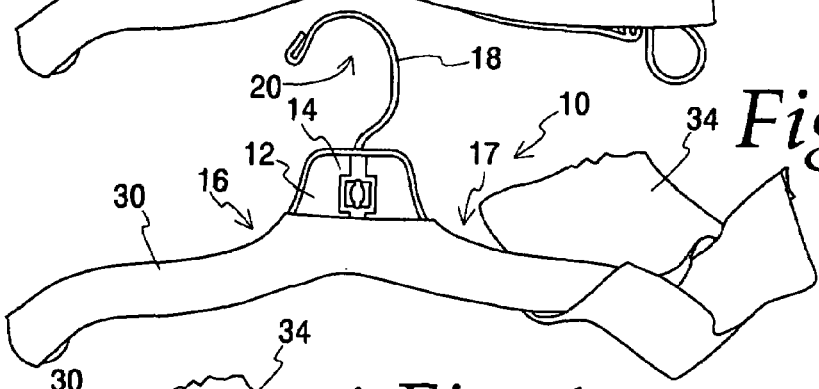
FIG. 3 shows the hanger of FIG. 1 with the padding secured thereon, and a decorative wrap initially being wound as a helix on the right end thereof.

The materials needed for decorating this conventional plastic hanger might include a resilient padding 30 for overlying the hanger, a wrap 34 for overlying the padding, and decorative yarn 38 for overlying the wrap, with all components then being held firmly in place on the hanger.

The padding 30 might be formed of a thin sheet of foamed rubber starting in a rectangular shape, having a width about the same as or slightly more than twice the height of each hanger end portion and a length about the same as or slightly less than the hanger length, measured across its opposite ends. The sheet padding 30 might be approximately ⅛" thick.

A central slit can be made in the sheet and extended a length approximately the same as the width of the upstanding central hanger region 14. When the sheet is folded in half along the slit, the ends of the sheet can be thermally or chemically bonded or mechanically stitched together, forming end pockets.

The folded and formed padding 30 can be stretched lengthwise slightly to be fitted over the top edge and opposite sides of the hanger end portions 16, 17, with the central portion 12 and hook 18 fitting through the padding slit and protruding upwardly beyond the padding and with the closed pocket ends overlying and held against the opposite hanger ends.

Figure 5:
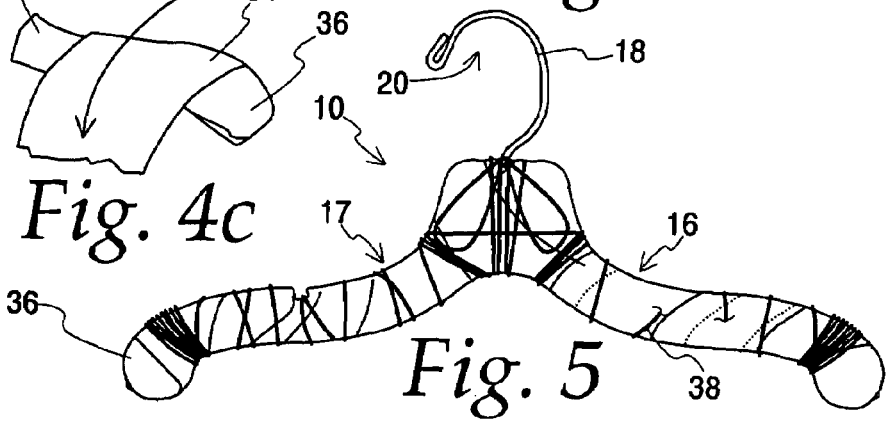
FIG. 5 shows the hanger of FIG. 1 with padding and over wrap thereon, and with decorative yarn somewhat randomly wound on the wrap, with part of the right ends yarn windings being broken away to expose the otherwise significantly covered overlapping helically wound wrap.

The wrap 34 can be a narrow strip or ribbon of colorful cloth, such as possibly 2-4 inches wide and of a length possibly two and four times the size of the hanger. The wrap is to be helically wound around the hanger body, covering and extending from one hanger end to the other hanger end, with the helix being wound at possibly a 25-40 degree angle and with the edges overlapping by possibly between ½ and 1 inch (see in FIG. 5 the solid and dotted lines in the broken away right end portion of the hanger end shoulder regions).

Figure 4A:
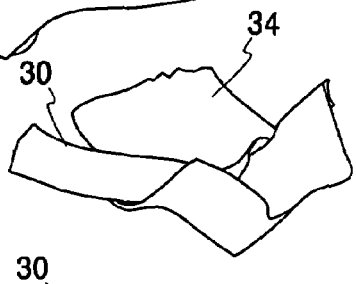
FIGS. 4*a*, 4*b* and 4*c* show sequentially how the wrap is initially wound on the right end of the hanger, with the initial end part of the helix being folded over and under the successive helical turns of the wrap, forming a clean end 36.
Figure 4B:
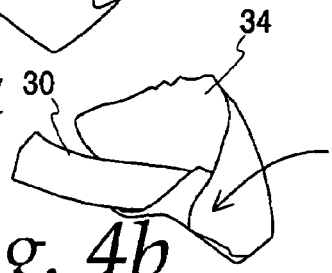
Figure 4C:
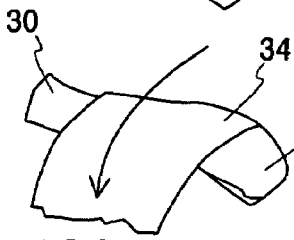

When winding the wrap 34, initially only the inward edge part of the wrap should overlap the hanger end, with the remaining outward wrap part being formed somewhat as a tube extending beyond the hanger end (see FIG. 4*a*). Thus, after a completed turn when a layer of wrap has been made, the free unsupported wrap tube can be folded over 180 degrees and positioned under the next following layers of the wrap, to provide a clean or neat finished hanger end appearance (see FIGS. 4*b* and 4*c*). A similar unsupported wrap tube can be formed at the left hanger end and folded over the solid hanger end, whereupon the trailing portion of the wrap can be wound over it, with the wrap then being angled to wind tightly back toward the hanger center for a turn or so.

The wrap will thus substantially cover the hanger body including both ends, although the wrap free end would not be permanently secured. A mechanical clamp or the like (not shown) can be secured over the loose-wrap end to hold it in place until being covered by the yarn windings, although an experienced operator typically would not need it.

The normal wrap helix should traverse and enclose the central portion of the hanger body, but not in a manner that would restrict rotation of the swivel hook 18.

The decorative yarn 38 can be wound over the padding and wrap for holding all in place. A preferred manner of doing this would be to secure one end portion of the yarn to the swivel hook, and then holding the hanger at the unsecured wrap end with one hand and winding with the other hand the yarn toward the loose wrap end. Multiple yarn turns can be made where needed for securely holding the underlying wrap. The yarn can be wound in any pattern, such as helically at one angle of advance out to the end turn, and back again toward the central region at the same but at a different angle of advance, so as to form crossing yarn patterns. When reaching the central portion, the yarn strands can but need not be knotted together then, however the yarn can continue to be wound out to the opposite hanger end and then back to the central hanger region. The two yarn ends can then be tied together, such as with a bow or the like.

The yarn needed can possibly be of a length between 10 and 20 times the hanger size, and should be of a gauge thick or broad enough to be visible even as a single strand when overlapping the wrap.

What is claimed is:

1. A method of decorating a plastic hanger having a thin profile body formed with an upstanding central region and downwardly sloping end shoulder regions and hanger ends, and a swivel hook secured at the central body region, comprising the steps of covering the hanger body with a resilient padding while allowing the central hanger region and swivel hook to extend through a slit in the padding so as to be exposed, winding a ribbon like wrap helically over the hanger body starting with a first folded tubular wrap end enclosing one hanger end and then to and over the central and end shoulder regions and ending with a second folded tubular wrap end enclosing the other hanger end, and applying a decorative yarn over the wrap by first securing one end of the yarn at the swivel hook and helically winding the yarn then substantially over one end shoulder region out to and proximate one hanger end and then back to cross both end shoulder regions and the central region substantially out to and over the other end shoulder region to the other hanger end and back to the central region, and knotting the yarn ends together at the swivel hook.

* * * * *